US007704077B1

(12) United States Patent
Morley

(10) Patent No.: US 7,704,077 B1
(45) Date of Patent: Apr. 27, 2010

(54) LOW LOSS BOARD TO BOARD CONNECTION SYSTEM

(75) Inventor: Stephen T Morley, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/422,837

(22) Filed: Apr. 13, 2009

(51) Int. Cl.
*H01R 12/00* (2006.01)

(52) U.S. Cl. ..... 439/63; 439/79

(58) Field of Classification Search ..... 439/63, 439/79, 271, 578–582
See application file for complete search history.

(56) References Cited

U.S. PATENT DOCUMENTS 7,484,999 B2 * 2/2009 Suzuki et al. ..... 439/581
7,500,873 B1 * 3/2009 Hart ..... 439/578
7,530,813 B1 * 5/2009 Tsai et al. ..... 439/63
7,563,103 B1 * 7/2009 Hall et al. ..... 439/63

OTHER PUBLICATIONS

MIL-STD-348A, Notice 5, Diagrams of Figure 328-1 "SMPM female interface", Figure 328-2 "SMPM male full detent interface" and Figure 328-3 SMPM male smooth bore interface, 3 pages.
Tyco Electronics, "Nanonics Coaxial Connectors", Catalog 1308638, Rev. 8-05, pp. 197-206.
Tensolite, "HDRFI™ Series: Tensolite High-Performance Cable & Interconnect Systems", 8 pp.
Corning Gilbert Inc., "GPPO™ Multip-position Block Series", 4 pp., (Jun. 2004).
W.L. Gore & Associates, Inc., "GORE™ Ultra High Density Interconnects", 2 pp.

* cited by examiner

*Primary Examiner*—Khiem Nguyen

(57) ABSTRACT

A board to board connection system is disclosed for RF signals, and comprises coaxial interconnection systems which interconnect a daughter card to a backplane.

15 Claims, 7 Drawing Sheets

LOW LOSS BOARD TO BOARD CONNECTION SYSTEM

FIELD OF THE INVENTION

The subject disclosure relates to a coaxial style connection system for interconnecting circuit boards such as a daughter board to a backplane.

RELATED APPLICATIONS

This application is related to U.S. patent application Ser. No. 12/422,838, filed on Monday Apr. 13, 2009 (the subject matter of which is incorporated herein by reference).

BACKGROUND OF THE INVENTION

Many different styles of connection systems are used to transmit radio frequency (RF) signals either in cable-to-cable connections or in board-to-board connections. One of the shortcomings of many of the present designs relates to the RF leakage between mated pairs. This shortcoming is multiplied when the lines are placed on a closer center-to-center line spacing. It would therefore be desirable to improve the channel-to-channel isolation.

The object of the present embodiment is to improve upon the channel-to-channel isolation.

SUMMARY OF THE INVENTION

In one embodiment, an electrical connector assembly comprises a first connector assembly comprised of a first housing module having first and second faces, and a receiving opening extending at least partially between the first and second faces; and an electrical contact assembly positioned in the receiving opening of the first housing module and having a first contact interface being positioned internal to the receiving opening and a second contact interface, the electrical contact assembly floating within the receiving opening. A second connector assembly is included which is comprised of a second housing module having first and second faces, and a receiving opening extending at least partially between the first and second faces, the first contact interface of the second connector member being positioned in an opposed manner from the first face of the first housing module; and an electrical contact assembly positioned in the receiving opening of the second housing module and having a first contact interface being receivable internally of the receiving opening of the first housing module, and a second contact interface. The assembly further comprises a seal member positioned intermediate the first and second housings.

In another embodiment, an electrical connector assembly comprises a first connector member comprised of a first housing module having first and second connection interfaces, and a receiving opening extending at least partially between the first and second connection interfaces; and an electrical receptacle assembly positioned in the receiving opening of the first housing module and having a first contact interface being positioned internal to the receiving opening and a second contact interface, the electrical receptacle assembly comprising an outer ground conductor with an inner electrical terminal isolated from the outer ground conductor, and the electrical receptacle assembly being spring loaded towards the first interface.

DETAILED DESCRIPTION

Figure 1:
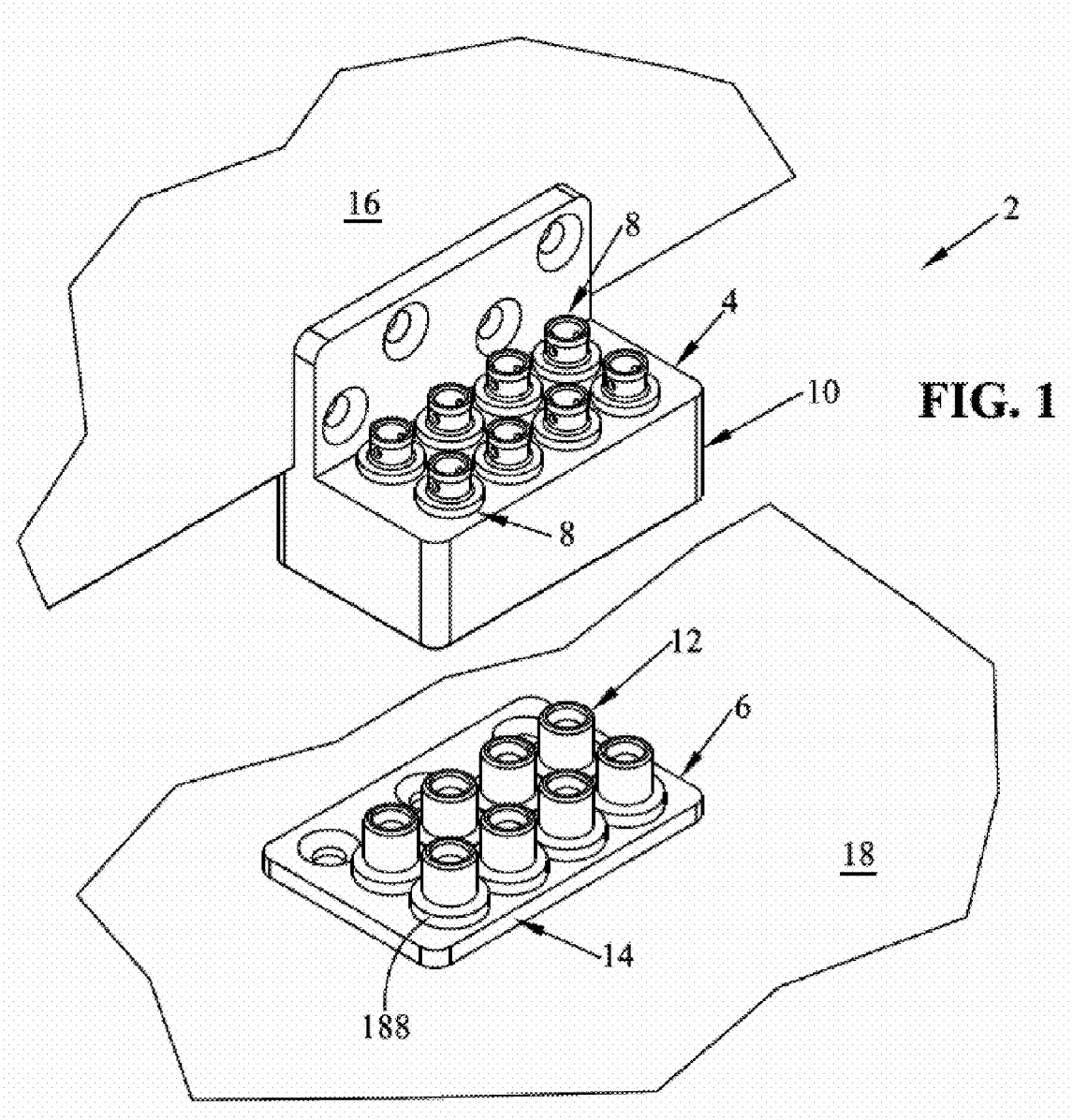
FIG. 1 discloses a connector plug assembly poised for receipt in a backplane connector.

With reference first to FIG. 1, an electrical connector assembly is shown at 2 comprising a connector plug assembly 4 and a connector receptacle assembly 6. As shown, connector plug assembly 4 is comprised of a coaxial plug contact assembly 8 and a housing module 10. Connector receptacle assembly 6 is comprised of a coaxial receptacle contact assembly 12 and a housing module 14. As it should be appreciated, connector plug assembly 4 is interconnectable to connector receptacle assembly 6 to interconnect the daughter board 16 and the backplane 18.

Figure 3:
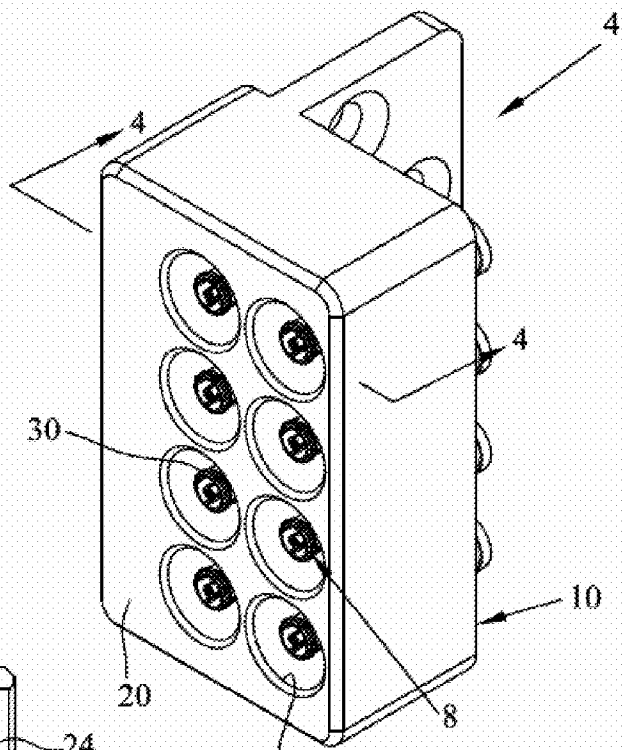
FIG. 3 discloses a bottom perspective view of the connector plug assembly of FIG. 2.
Figure 2:
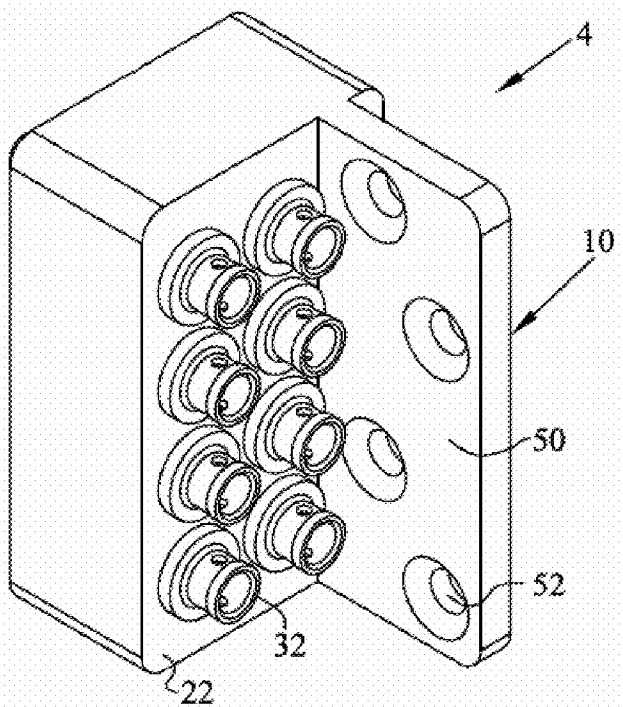
FIG. 2 discloses a top perspective view of the connector plug assembly.

With respect to FIGS. 2 and 3, connector plug assembly 4 is shown in greater detail. As shown, housing module 10 includes a first or front face 20 and a second or rear face 22 with receiving openings 24 extending between the first and second faces 20, 22. As shown best in FIG. 3, coaxial plug contact assembly 8 is shown having a first contact interface 30 positioned adjacent to first face 20 and as best shown in FIG. 2 has a second contact interface 32 positioned adjacent to second face 22.

Figure 4:
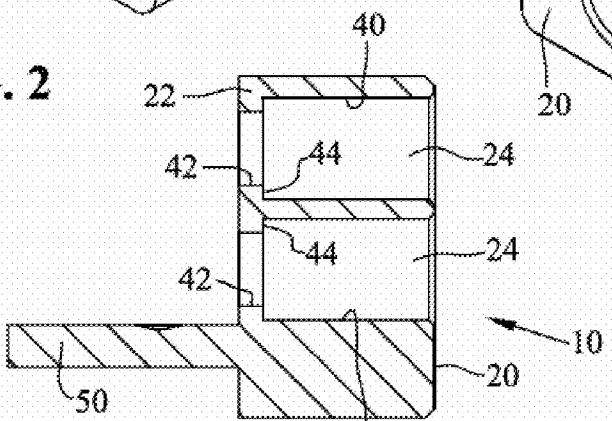
FIG. 4 discloses a cross-sectional view through lines 4-4 of FIG. 3, without the contact assemblies in place.

As shown best in FIG. 4, the receiving openings 24 are defined by a bored hole extending inwardly from the first face 20 and defines an enlarged opening portion 40 and a constricted opening portion 42. Enlarged opening portion 40 opens onto first face 20 and constricted opening 42 opens onto second face 22. The intersection of the enlarged opening 40 and a constricted opening 42 defines a shoulder 44 adjacent to second face 22. With respect again to FIG. 2, housing module 10 further comprises a mounting portion 50 having mounting apertures 52.

With respect now to FIG. 5, coaxial plug contact assembly 8 will be described in greater detail. Coaxial plug contact assembly 8 is comprised of inner plug housing portion 60, outer plug housing portion 62, insulator 64, socket contact 66, compression spring 68, and retaining ring 70. Inner plug housing portion 60 includes an L-shaped notch 80 having a longitudinally extending portion 82, laterally extending portion 84, and detent 86. Inner plug housing portion 60 further includes a plurality of ground contacts 88 where the inner plug housing portion 60 is comprised of a conductive material such as a metal. As shown best in FIG. 6, inner plug housing portion 60 further includes an inner diameter at 90 defining a rearwardly facing shoulder at 92. Inner plug housing portion 60 further includes inner diameter portion 96 which defines rearwardly facing edge 98.

Figure 7:
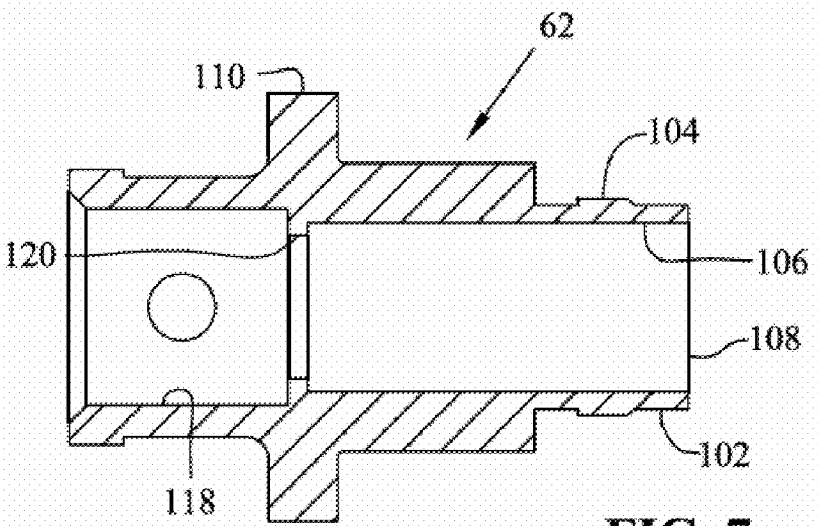
FIG. 7 discloses a cross-sectional view through lines 7-7 of FIG. 5.

With respect again to FIG. 5, outer housing portion 62 includes a center diameter portion 100, a ferrule 102 having a raised ring portion 104, where the ferrule 102 has an inner diameter at 106 and which defines an end face at 108. An enlarged ring portion 110 is positioned on central portion 100 and defines a forwardly facing surface 112. Outer housing portion 62 also includes a receptacle portion 116 and as best shown in FIG. 7, includes an inner diameter at 118 and a reduced diameter at 120.

Figure 5:
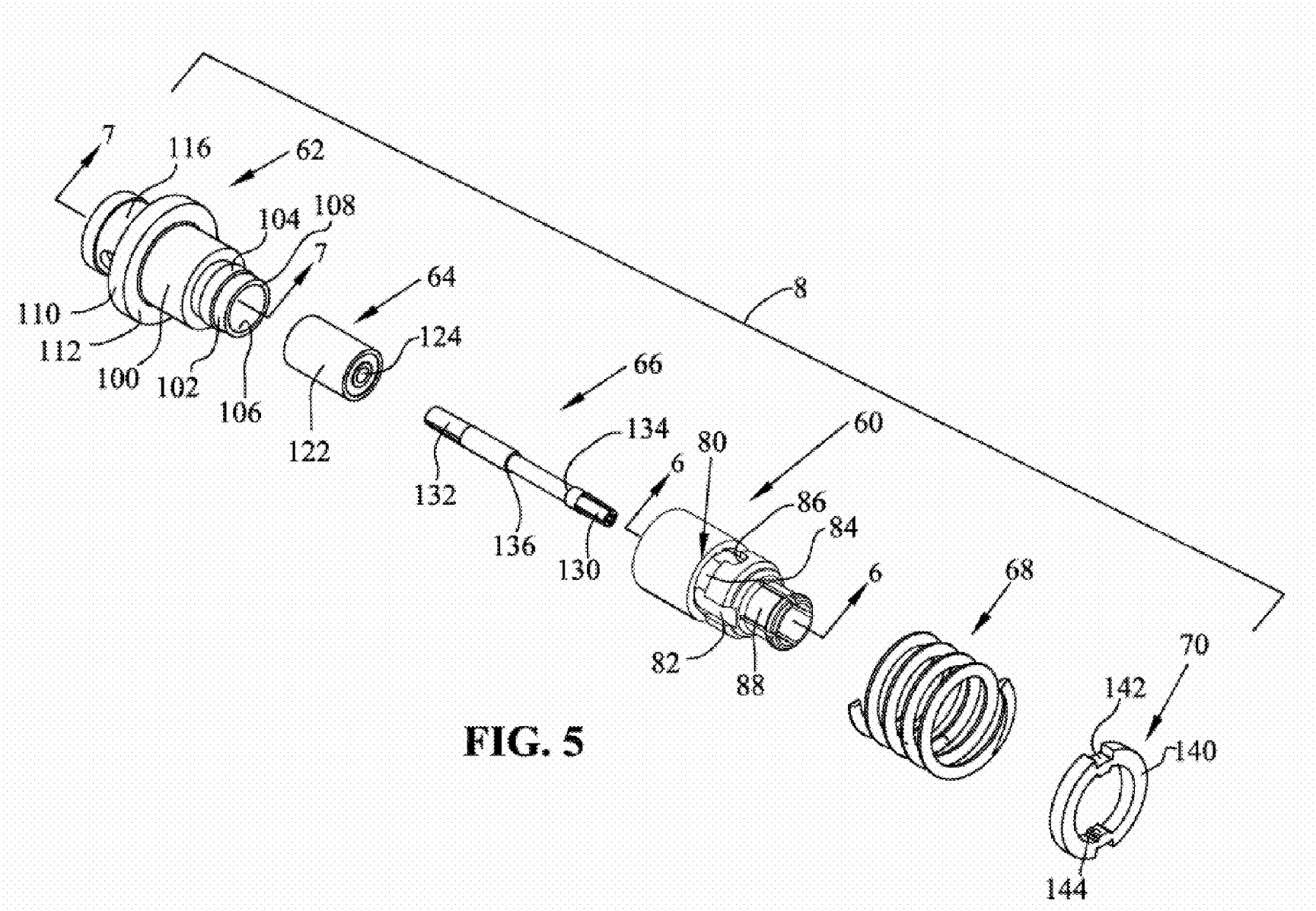
FIG. 5 discloses an exploded view of the contact assembly for the connector plug assembly.
Figure 6:
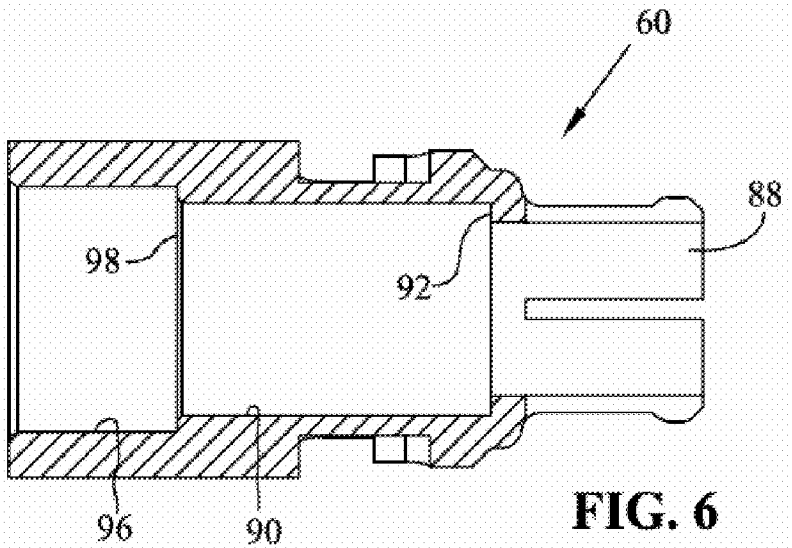
FIG. 6 discloses a cross-sectional view through lines 6-6 of FIGS. 5.

With reference still to FIG. 5, insulator 64 includes an outer diameter at 122 and an internal opening at 124. Socket contact 66 includes a first socket portion 130, a second socket portion 132, and first and second shoulders 134, 136. Finally, locking ring 70 includes a circular ring portion 140 having engaging openings at 142 and locking lugs at 144.

Figure 9:
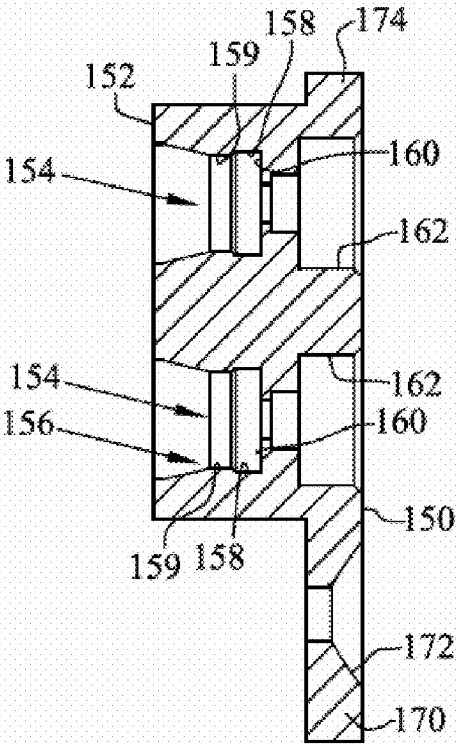
FIG. 9 discloses a cross-sectional view through lines 9-9 of FIG. 8.
Figure 8:
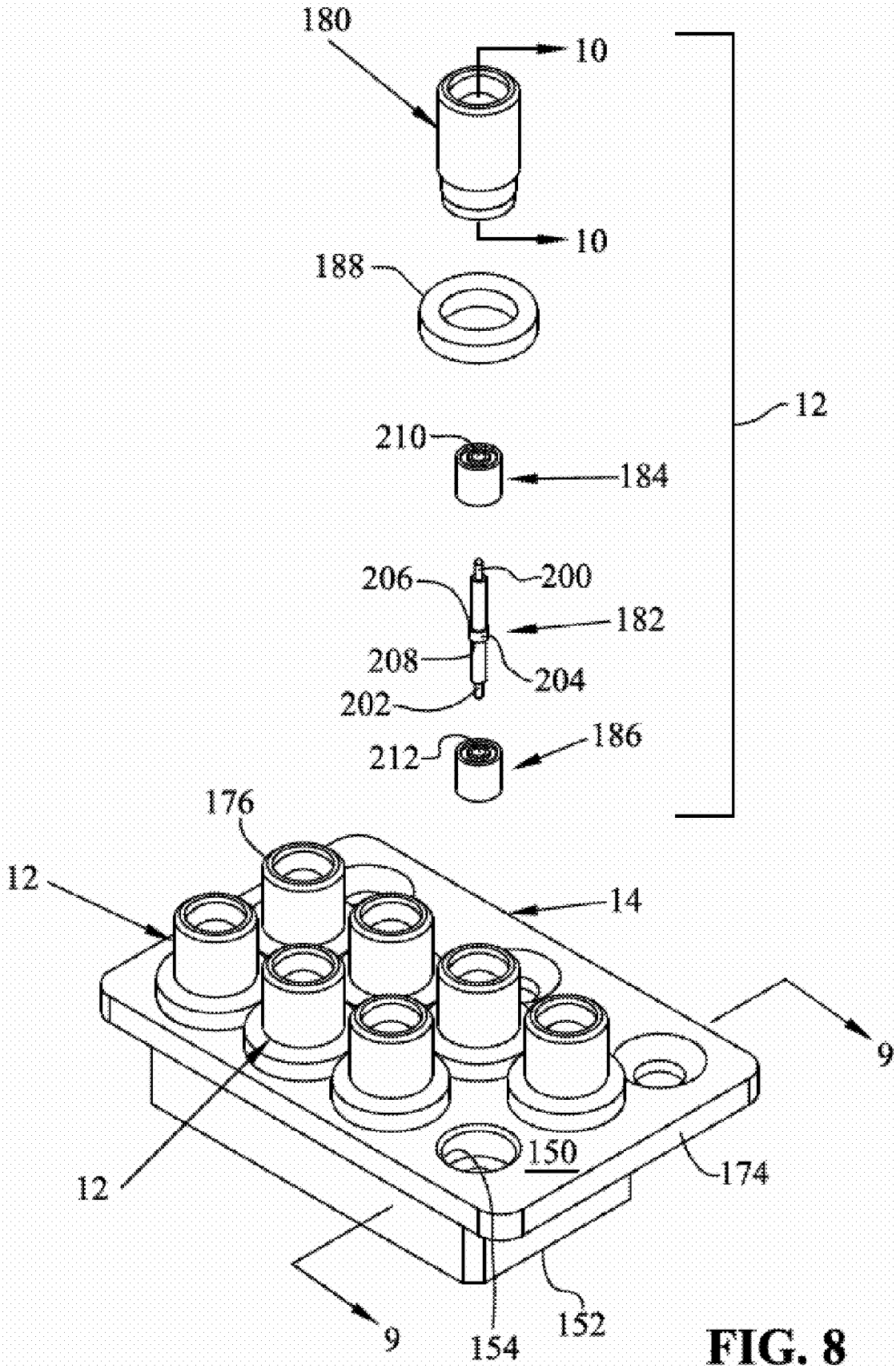
FIG. 8 discloses an exploded view of the connector receptacle assembly.
Figure 12:
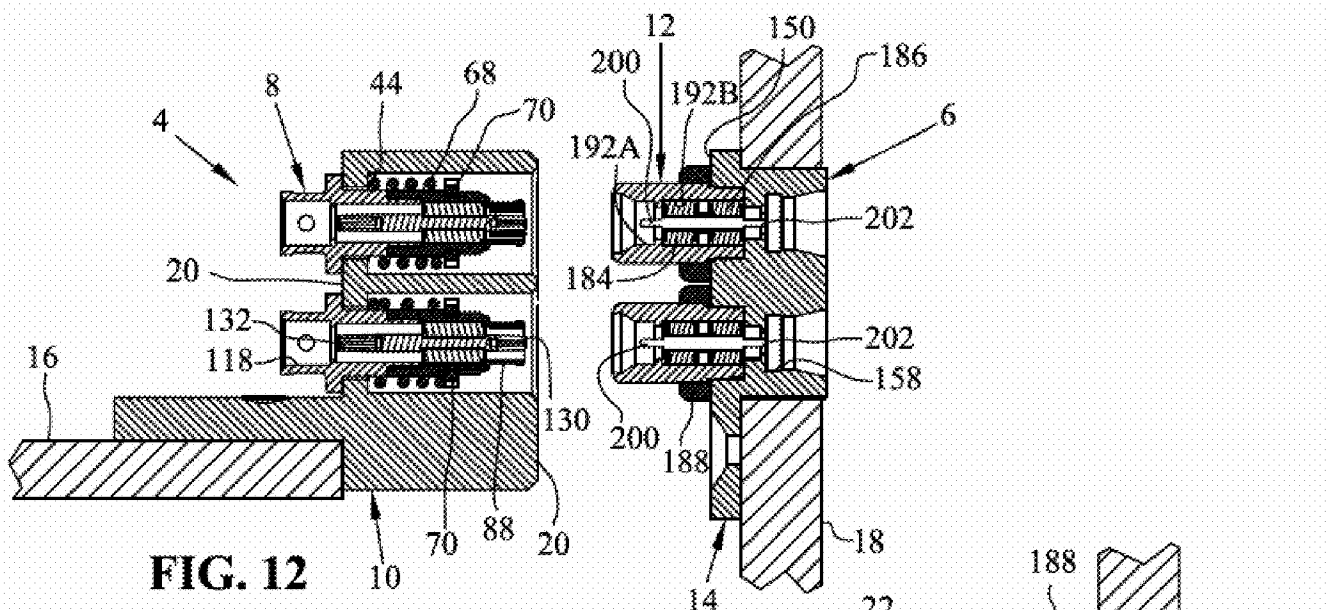
FIG. 12 discloses a cross-sectional view through the connector plug assembly and connector receptacle assembly and poised for interconnection to each other.

With reference now to FIGS. 8 and 9, connector receptacle assembly 6 will be described in greater detail. As shown in FIG. 8, connector receptacle assembly 6 is shown with one of the coaxial receptacle contact assemblies 12 exploded from the housing module 14. Housing module 14 includes first or front face 150, second or rear face 152, and receiving openings 154 extending between faces 150, 152. Receiving openings 154 include a first diameter section 158, defining an end face 160, and opening portions 162 defined to receive a mating connector as further described herein. Housing module 14 also includes a mounting portion 170 having mounting apertures 172 and a flange portion 174, where the mounting portion 170 cooperates with flange portion 174 for mounting to an opening in the back plane 18, as further described herein. Coaxial receptacle contact assemblies 12 define a first contact interface 176, and a second contact interface 178 (FIG. 12).

With reference still to FIG. 8, coaxial receptacle contact assembly 12 is shown as comprised of receptacle housing portion 180, pin terminal 182, and insulators 184, 186. As shown best in FIG. 10, receptacle housing module 180 includes a rear diameter portion 190, first inner diameter portion 192A, second inner diameter portion 192B, lead-in portion 194, and diameter portion 196 defining a rearwardly facing shoulder 198 as defined herein.

Pin terminal 182 includes first and second pin portions 200, 202, and an intermediate diameter portion 204 defining edges 206, 208. Insulator 184 is comprised of a through opening 210 while insulator 186 includes a through opening 212. As also shown in FIG. 8, coaxial receptacle contact assemblies 12 further includes D-ring seals 188 which are conductively compressive members. D-ring seals 188 could be made from a material such as a fluoro-silicon or a silicon rubber which is impregnated with conductive particles such as silver.

The assembly of the connector plug assembly 4 and the connector receptacle assembly 6 will be assembled as follows. With respect again to FIG. 5, coaxial plug contact assembly 8 will be described. Socket contact 66 is first inserted into opening 124 such that insulator 64 is trapped between shoulders 134, 136. The combination of the insulator 64 and socket contact 66 is then inserted into the inner diameter 90 (FIG. 6) of the inner plug housing portion 60 until insulator 64 abuts shoulder 92. Inner plug housing portion 60, together with insulator 64 and socket contact 66, can then be positioned over outer plug housing portion 62 such that inner diameter portion 96 (FIG. 6) is received over ferrule 102. It should be understood that this connection is a semi-permanent connection and can be made by known means such as interference fit, soldering, sweat fitting, threadable connection, or the like. When in position, insulator 64 abuts end face 108 to trap insulator in position between housing portions 60, 62.

Figures 10, 11:
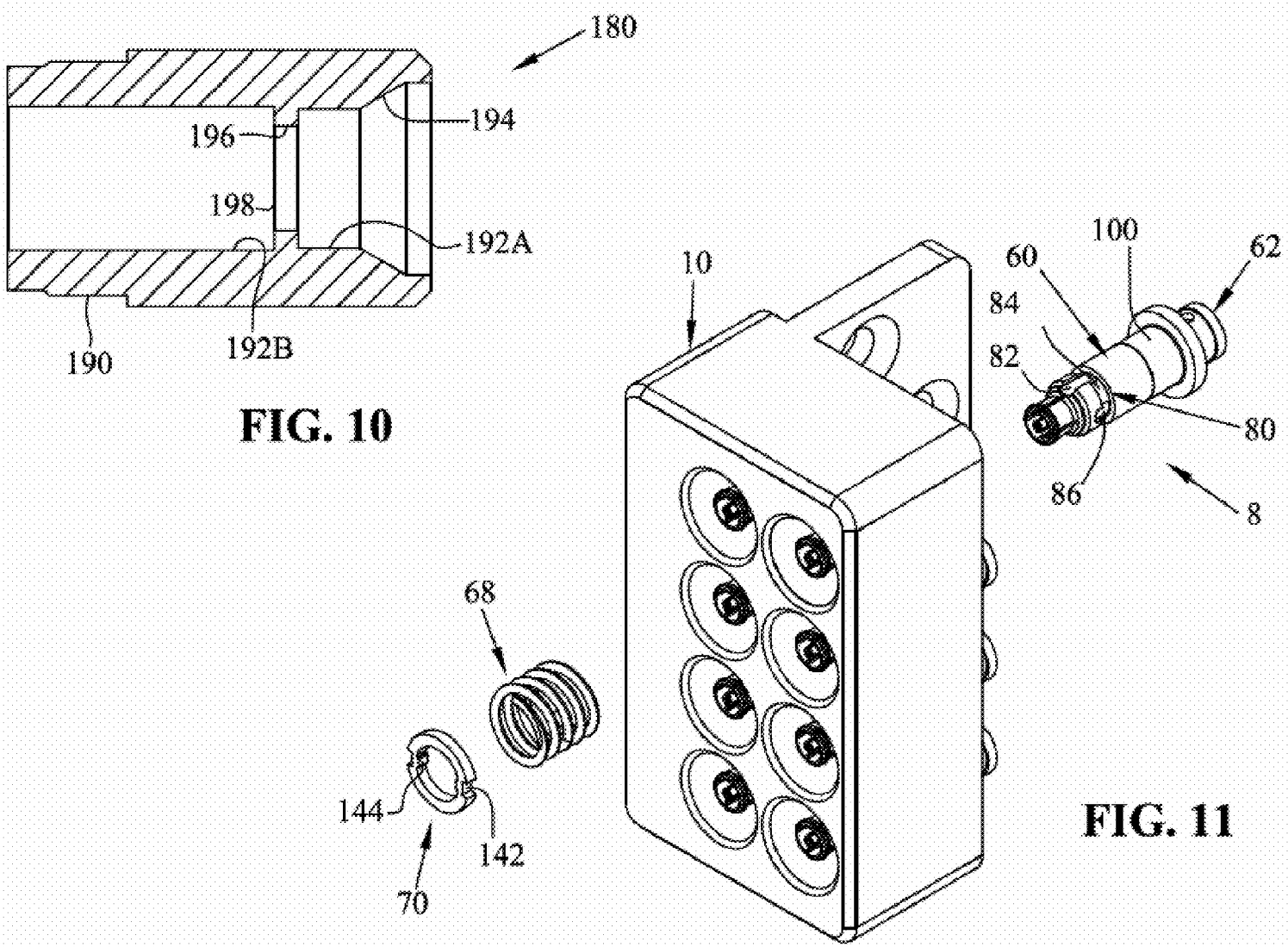
FIG. 10 discloses a cross-sectional view through lines 10-10 of FIG. 8.
FIG. 11 discloses the assembly of the connector plug assembly.

With reference now to FIG. 11, this assembly may now be positioned into housing module 10 with diameter portion 100 being positioned into constricted openings 42 (FIG. 4). Compression spring 68 may now be received over inner plug housing portion 60 and retaining ring 70 may now be positioned in a longitudinal sense with the locking lugs 144 aligned with the longitudinally extending portions 82 of the L-shaped recess 80. It should be appreciated that a tool may grip the engaging openings 142 and the locking ring 70 may be pushed longitudinally inward, compressing compression spring 68 until such time as the locking lugs 144 reach the laterally extending sections 84 whereupon the locking ring 70 may be rotated such that lugs 144 travel in laterally extending sections 84 to the detent 86 where the locking ring is locked in place. As shown in FIG. 12, compression spring 68 is compressively sprung between shoulder 44 of housing module 10 and locking ring 70, spring loading coaxial plug contact assembly 8 towards first face 20 of module 10.

With reference now to FIG. 8, coaxial receptacle contact assembly 12 is assembled by inserting pin contact 182 into through opening 210, and inserting insulator 186 with through opening 212 over pin terminal 182. This assembly may now be received within the inner diameter 192B (FIG. 10) of receptacle housing 180 until such time as it is received against rearwardly facing shoulder 198 (FIG. 10). This positions pin portion 200 adjacent to inner diameter portion 192A. This assembly may now be received in housing module 14 with rear diameter portion 190 (FIG. 10) received in first diameter section 158 (FIG. 9), and into the position shown in FIG. 12. This positions pin portion 202 within inner diameter portion 192B and positions D-ring seal 188 adjacent to first face 150.

Figure 13:
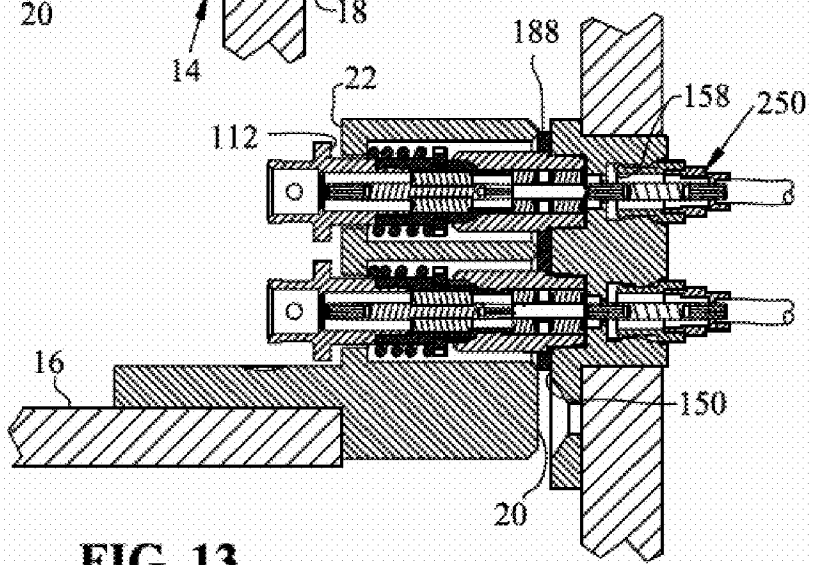
FIG. 13 is similar to that of FIG. 12 showing the connector plug assembly and connector receptacle assembly assembled.

The two connector assemblies 4 and 6, and their associated boards 16, 18, may now be brought into mating engagement into the configuration shown in FIG. 13. In this configuration, and as shown in FIGS. 12 and 13, pin portion 200 engages first socket contact portion 130 and ground contacts 88 contact the inner diameter portion 192A of receptacle housing portion 180.

It should also be appreciated that this interface, that is, the position where the first contact interface 30 of coaxial plug contact assembly 8 interfaces with the first contact interface 176 (FIG. 8) of coaxial receptacle contact assembly 12, occurs within receiving openings 24, recessed from first face 20. This interface is also within a metal hosing module 10. It should also be appreciated that coaxial plug contact assembly 8 is spring loaded towards coaxial receptacle contact assembly 12. As shown, forwardly facing surfaces 112 of coaxial plug contact assembly 8 is spaced from second face 22, and as shown, the nominal spacing is in the range of 40 to 50 millimeters allowing coaxial plug contact assembly 8 to spring loadably float within receiving opening 24 by that amount. This ensures that each of the ground contacts 88 is continuously and fully engaged within inner diameter portion 192A of receptacle housing portion 180. This also accounts for any discrepancy between the multiple contacts as to their various longitudinal positions. Finally, as shown, D-ring seal 188 is shown compressed between faces 20 and 150 which isolates the space between the surfaces as well as the space between individual receiving openings 24. All of these items either individually or in the aggregate increase the channel-to-channel isolation of the connection between connector plug assembly 4 and connector receptacle assembly 6.

As should be appreciated the housing modules 10, 14 are comprised of conductive material and may be metallic for EMI/RFI purposes. It should also be appreciated that the coaxial plug contact assembly 8 and the coaxial receptacle contact assembly 12 each carry (and interconnect) an RF signal comprised of a signal and a ground, and that each signal is isolated from the other by way of the insulators 64, 184 and 186. Further more, it should be appreciated that the first diameter section 158 and pin portion 200 together define a receptacle for the interconnection of a mating connector 250 as shown in FIGS. 12 and 13. In a like manner, and as shown in FIGS. 12 and 13, inner diameter 118 and socket portion 132 define a receptacle for the interconnection of a mating connector (not shown). It also be appreciated that the interconnection to a mating connector such as 250 need not be made through a receptacle interface, but could be any form of connection, such as bayonet, screw in, etc.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector assembly, comprising:

a first connector assembly comprised of:

a first housing module having first and second faces, and a receiving opening extending at least partially between the first and second faces; and an electrical contact assembly positioned in the receiving opening of the first housing module and having a first contact interface being positioned internal to the receiving opening and a second contact interface, the electrical contact assembly floating within the receiving opening;

a second connector assembly comprised of:

a second housing module having first and second faces, and a receiving opening extending at least partially between the first and second faces, the first connection interface of the second connector member being positioned in an opposed manner from the first face of the first housing module; and an electrical contact assembly positioned in the receiving opening of the second housing module and having a first contact interface being receivable internally of the receiving opening of the first housing module, and a second contact interface; and a seal member positioned intermediate the first and second housings.

2. The electrical connector assembly of claim 1, wherein the electrical contact assembly of the first connector member is a coaxial plug assembly and comprises an outer ground conductor with an inner electrical terminal isolated from the outer ground conductor.

3. The electrical connector assembly of claim 2, wherein the electrical contact assembly of the second connector member is a coaxial receptacle assembly and comprises an outer ground conductor with an inner electrical terminal isolated from the outer ground conductor.

4. The electrical connector assembly of claim 2, wherein the second connection interface of the plug assembly is comprised of a ground connection and a signal connection.

5. The electrical connector assembly of claim 3, wherein the second connection interface of the receptacle assembly is comprised of a ground connection and a signal connection.

6. The electrical connector assembly of claim 2, wherein the first housing module is conductive.

7. The electrical connector assembly of claim 6, wherein the first housing module is metallic and comprises a plurality of receiving openings for receiving a plurality of electrical contacts.

8. The electrical connector assembly of claim 7, wherein the receiving openings of the first housing are defined as bored holes inward from the first face.

9. The electrical connector assembly of claim 6, wherein the receiving opening of the first housing module comprises an enlarged opening portion which opens onto the first face, and a constricted opening which opens onto the second face.

10. The electrical connector assembly of claim 9, wherein the intersection of the enlarged opening portion with the constricted opening defines a shoulder adjacent to the second connection interface.

11. The electrical connector assembly of claim 10, wherein a compression spring surrounds plug assembly and abuts the shoulder.

12. The electrical connector assembly of claim 11, wherein the seal member is comprised of an elastomeric member impregnated with silver particles.

13. The electrical connector assembly of claim 1, wherein the electrical contact of the first connector member is spring loaded towards the first face of the first housing module.

14. The electrical connector assembly of claim 1, wherein the first connector member is attached to a daughter card.

15. The electrical connector assembly of claim 13, wherein the second connector member is attached to a backplane.

* * * * *